US010933960B2

(12) United States Patent
Shaw

(10) Patent No.: US 10,933,960 B2
(45) Date of Patent: Mar. 2, 2021

(54) DRIVE SYSTEM FOR A PROPELLER

(71) Applicant: Superprop Limited, York (GB)

(72) Inventor: Christopher Shaw, York (GB)

(73) Assignee: SUPERPROP LIMITED, York (GB)

( * ) Notice: Subject to any disclaimer, the term of this patent is extended or adjusted under 35 U.S.C. 154(b) by 35 days.

(21) Appl. No.: 16/324,144

(22) PCT Filed: Aug. 10, 2017

(86) PCT No.: PCT/GB2017/052361
§ 371 (c)(1),
(2) Date: Feb. 8, 2019

(87) PCT Pub. No.: WO2018/029480
PCT Pub. Date: Feb. 15, 2018

(65) Prior Publication Data

US 2020/0156747 A1 May 21, 2020

(30) Foreign Application Priority Data

Aug. 10, 2016 (GB) ..... 1613725

(51) Int. Cl.
*B63H 1/20* (2006.01)
*B63H 23/34* (2006.01)

(52) U.S. Cl.
CPC ..... *B63H 1/20* (2013.01); *B63H 23/34* (2013.01)

(58) Field of Classification Search
CPC ... B63H 1/00; B63H 1/14; B63H 1/15; B63H 1/20; B63H 1/24; B63H 21/00; B63H 21/30; B63H 23/00; B63H 23/34
USPC ..... 440/52, 75
See application file for complete search history.

(56) References Cited

U.S. PATENT DOCUMENTS 2,974,502 A * 3/1961 Radcliffe ..... F04D 29/263 416/134 R
3,047,074 A * 7/1962 Rielag ..... B63H 1/20 416/134 R
3,113,625 A * 12/1963 Conover ..... B63H 1/20 416/134 R (Continued)

FOREIGN PATENT DOCUMENTS

EP 0 547 913 A1 6/1993

*Primary Examiner* — Lars A Olson
(74) *Attorney, Agent, or Firm* — Woodard, Emhardt, Henry, Reeves & Wagner, LLP

(57) ABSTRACT

The invention relates to a drive system, and method of forming the same, for a craft in water, said drive system comprising a drive means, one or more shafts which are provided in connection with the drive means via one or more gear assemblies and at least one of said shafts having a free end with location means to allow the same to be located with a propeller of the said craft to impart rotational drive to the propeller. The location means are at least partially located within a port in the body of the propeller and intermediate said location means and the walls of the said port there is provided a substantially non-conductive deformable material sleeve which separates the propeller body from the said shaft and retains the propeller body in drive engagement with the location means. The provision of the sleeve allows the electrical isolation of the sleeve and propeller, allows a more robust connection between the propeller and drive means and reduces the impact of vibration on the operation and efficiency of the propeller.

19 Claims, 5 Drawing Sheets

(56) References Cited

U.S. PATENT DOCUMENTS

Figure 1B:
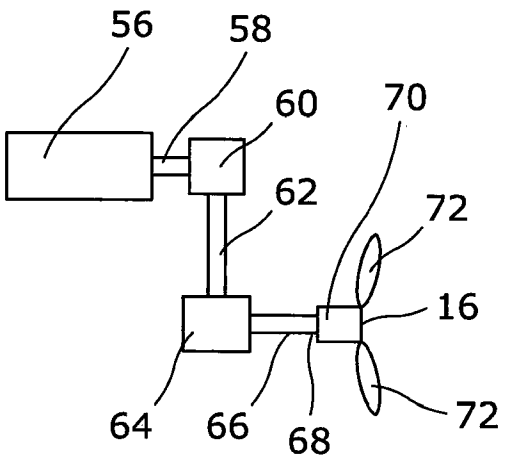

| | | | | | |
|---|---|---|---|---|---|
| 3,563,670 | A * | 2/1971 | Knuth | B63H 1/20 | 416/134 R |
| 3,748,061 | A * | 7/1973 | Henrich | B63H 23/34 | 416/134 R |
| 3,871,324 | A * | 3/1975 | Snyder | B63H 23/34 | 416/134 R |
| 3,876,332 | A * | 4/1975 | Kashmerick | B63H 23/34 | 416/134 R |
| 4,041,730 | A * | 8/1977 | Kress | B63H 23/34 | 416/134 R |
| 4,204,806 | A * | 5/1980 | Blanchard | B63H 1/24 | 416/134 R |
| 4,310,285 | A | 1/1982 | Blanchard | | |
| 4,575,310 | A * | 3/1986 | Otani | B63H 1/20 | 416/134 R |
| 5,522,743 | A * | 6/1996 | Patti | B63H 1/20 | 416/134 R |
| 5,630,704 | A * | 5/1997 | Gilgenbach | B63H 23/34 | 416/134 R |
| 6,383,042 | B1 | 5/2002 | Neisen | | |
| 7,488,225 | B2 * | 2/2009 | Lin | B63H 23/34 | 440/52 |

* cited by examiner

DRIVE SYSTEM FOR A PROPELLER

The invention to which this application relates is to a drive system which, in particular, although not necessarily exclusively, can be used to allow for the rotation of a propeller in order to allow propulsion of a craft through a body of water. In particular, although not necessarily exclusively, the propeller is used on a craft in which other means of propulsion are also provided so that the use of the propeller is required to ensure the ability to move the craft when the other forms of propulsion such as, for example sails, cannot be used.

Typically, with this form of propulsion system which is conventionally provided and periodically used, then as the system is not provided for continuous use but rather for sporadic use, the drive system is often not particularly robust and is therefore susceptible to failure after a relatively short period of time or installation. The drive system typically includes an engine, typically a diesel powered engine, provided within the hull of the craft such as a yacht, which has a rotating shaft which is attached to a further drive shaft via a gearing assembly. This further shaft protrudes outwardly from the hull and into the body of water and, via a further gearing assembly, is connected to the propeller via a splined or other form of drive connection in order to rotate the propeller and hence move the craft through the body of water. As the drive shaft and propeller, are constantly in the body of water, such as sea water, there is a need for the propeller body to be electrically isolated from the shaft so as to prevent conduction between the propeller and shaft as, if the same are in contact then the corrosion of the shaft and/or propeller body, is increased and therefore further shortens the life of at least these components and/or the system as a whole.

A further problem which is experienced is that due to the requirement for the gearing assembly to be provided to connect the engine shaft to the drive shaft, there is a significant amount of vibration created as the various components move when driven. This vibration can cause failure, particularly of the gearing assemblies, after a period of time of use. Typically, when this occurs, it is then necessary to replace all or at least part of the system at significant expense, both in terms of the components which need to be replaced and also the time for which the craft is required to be out of the water while the system is disabled and being repaired.

The gearing assemblies in the part of the drive that directs the drive from the typically substantially vertically oriented shaft to the substantially horizontally splined shaft in engagement with the propeller are constrained in size by the need to house them in a relatively thin leg or housing which is shaped so as to not seriously impede the water flow around the vessel. They are typically of a form which is the same as that used for a water craft outboard motor and, as such, are designed to have a relatively short life and be provided for non-continuous use. These constraints, and the torsional vibrations arising from their relatively short connections to both the diesel engine and the propeller, lead to the same having a relatively short life expectancy.

As such, there is therefore a need to solve this significant problem and a problem which, until now, has been regarded as something which has to be borne and accepted by the craft owner as one of the disadvantages, of yachts in particular.

An aim of the present invention is therefore to enable the location of the propeller with respect to a shaft of the drive system in a manner which allows the propeller to be conductively isolated from the shaft in a reliable and prolonged manner. A further aim is to allow attachment of the propeller to the shaft in a manner which allows the vibration which is inherent within the drive system, to be at least reduced with respect to the connection between the spline shaft and the propeller.

In a first aspect of the invention, there is provided a drive system for a craft in water, said drive system comprising a drive means, one or more shafts which are provided in connection with the drive means via one or more gear assemblies and at least one of said shafts having a free end with location means to allow the same to be located with a propeller of the said craft to impart rotational drive to the propeller and wherein said location means are at least partially located within a port in the body of the propeller and intermediate said location means and the walls of the said port there is provided a sleeve which separates the propeller body from the said shaft and retains the propeller body with the location means.

In one embodiment, the sleeve is open at both ends. In one embodiment the sleeve is closed and in one embodiment the closed end is formed by the same material used to form the sleeve.

In one embodiment the material used to form the sleeve has the characteristics of any, or any combination, of being deformable, non-conductive and/or non-compressible.

In one embodiment the sleeve is substantially annular in cross section

In one embodiment, the sleeve is formed such that at least a first end of the sleeve which lies at or adjacent to the opening into the port, is narrower in terms of the wall thickness than a further portion of said sleeve.

In one embodiment, there is provided a casing which is in drive engagement with the location means and overlies the same and is located in the port of the propeller body to allow drive to be imparted from the shaft to the propeller. Typically, the shape of the deformable material sleeve which is located against the wall of the casing, is of a shape so as to allow the drive to be imparted to the sleeve and hence to the body of the propeller.

Typically, the wall of the port and the location means or casing are provided of a shape so as to contact and define the shape of the said sleeve.

In one embodiment, the material used to form the sleeve is sufficiently deformable so as to take into account variances in the dimensions of the drive components but is substantially non-compressible so that the consistency of the wall thickness of the sleeve prevents the propeller from being displaced from a drive engagement with the shaft in normal use.

In one embodiment, the deformable material is a polyurethane rubber and the same is introduced in a liquid form into a cavity formed between the propeller body and the shaft location means, or casing, if provided.

In one embodiment the material used has a compression characteristic that requires a pressure of at least 1200 psi to be applied to the same in order to produce a 10% deflection at shape Factor=1.0. More preferably the pressure which is required to be applied is greater than 2500 psi. In one embodiment the shape of the sleeve which is created is also designed to render the sleeve non-compressible.

In one embodiment, the propeller is of a type which is described in the Applicant's co-pending patent application WO2016/034871.

In a further aspect of the invention there is provided a craft for water, such as a yacht which includes a drive system as herein described.

In a further aspect of the invention there is provided a method of forming a drive system for a craft in water, said method including the steps of providing a drive means, one or more shafts which are provided in connection with the drive means via one or more gear assemblies and at least one of said shafts having a free end, forming location means at said free end to allow the same to be located with a propeller of the said craft to impart rotational drive to the propeller when the shaft is driven to rotate by the drive means, positioning said location means at least partially within a port formed in the body of the propeller and, intermediate said location means and the walls of the said port there is provided a cavity and wherein a substantially non-conductive material is retained in said cavity so as to separate the propeller body from the said shaft whilst retaining the propeller body in contact with the location means.

In one embodiment the said material is introduced into said cavity in a flowable form and then sets or cures in position in said cavity to join the propeller and location means of the shaft in a drive relationship.

In one embodiment, when formed, the sleeve is substantially non-conductive and/or deformable and/or substantially non-compressible.

Figure 1A:
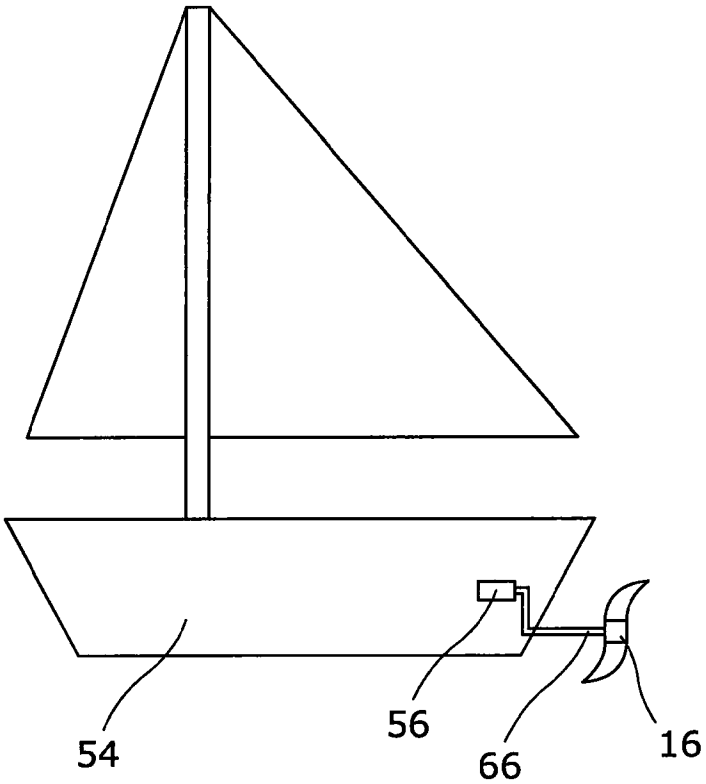

Specific examples of the invention are now described with reference to the accompanying drawings; wherein FIGS. 1*a* and 1*b* illustrate a drive system in accordance with one embodiment of the invention.

Figure 2A:
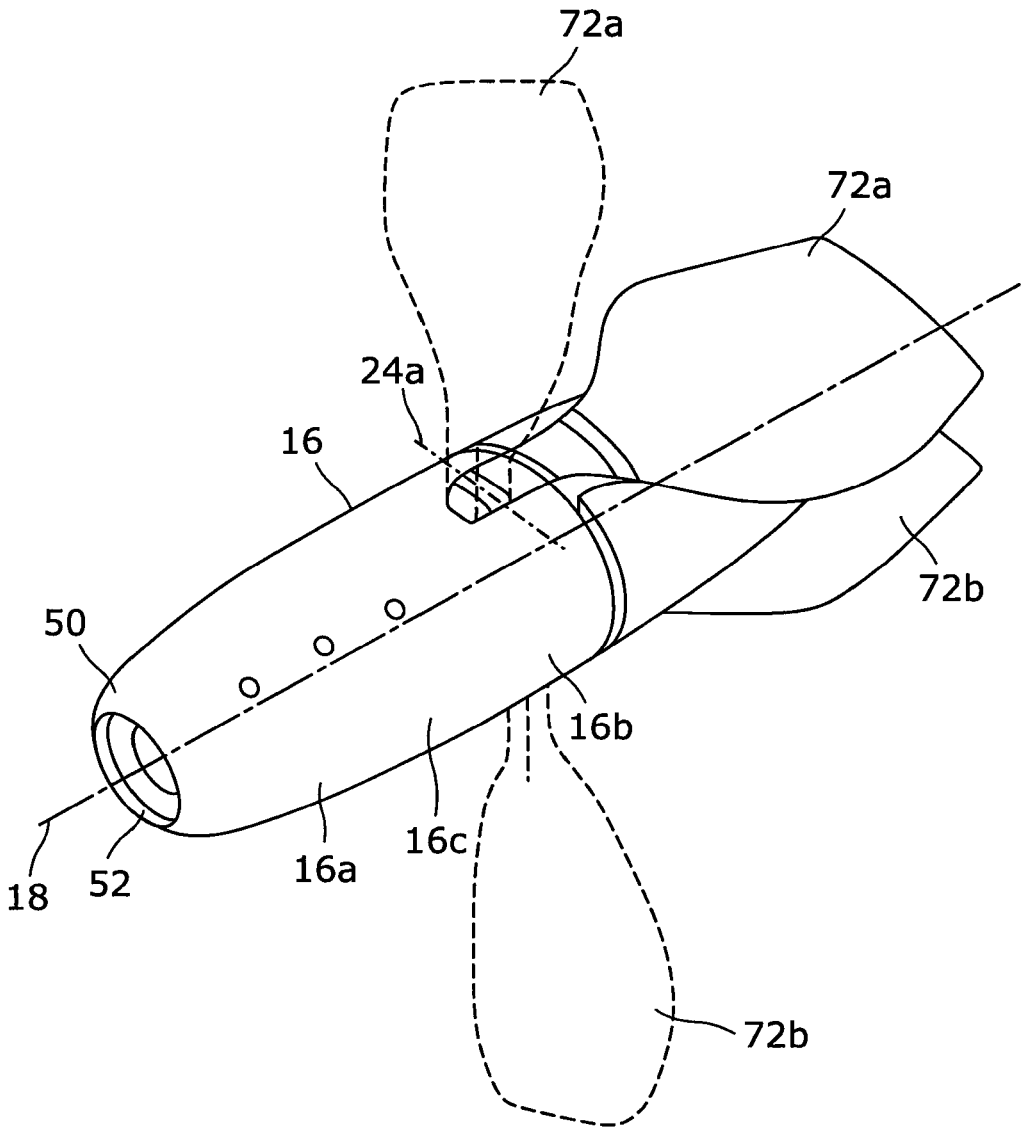
Figure 3B:
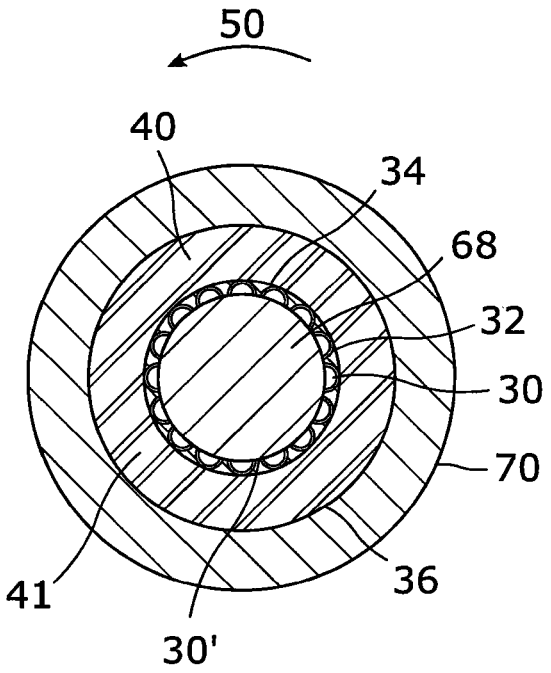
Figure 3A:
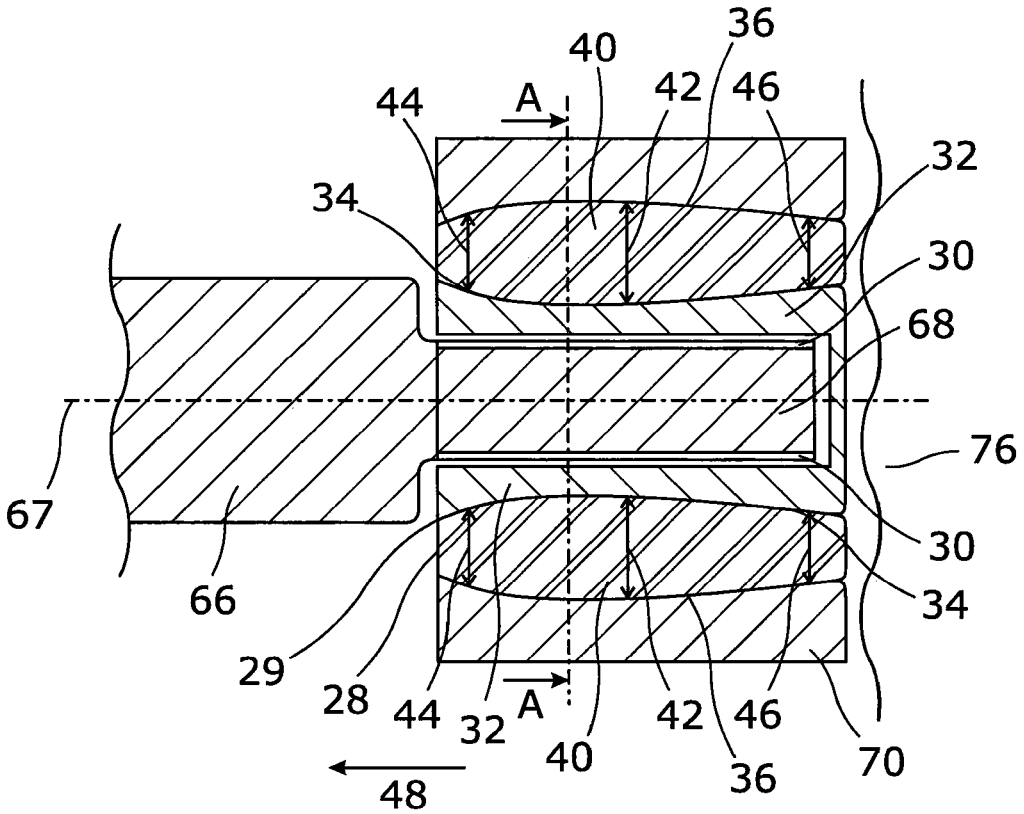
Figure 4A:
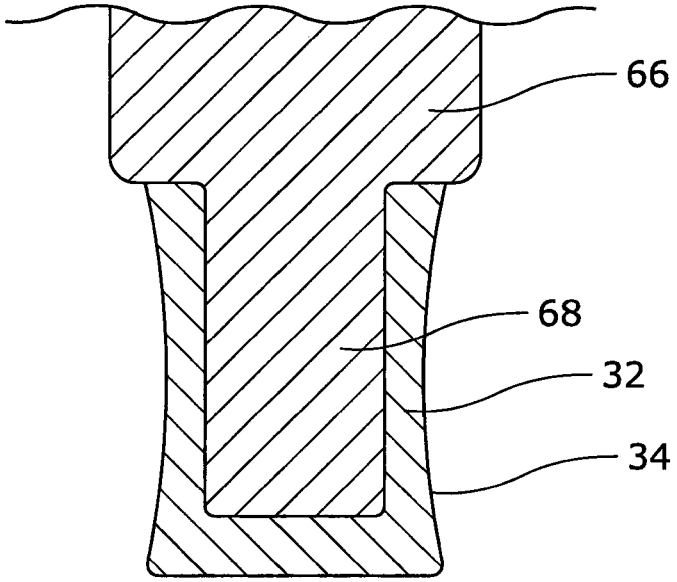

FIGS. 2*a* and *b* illustrate a propeller in one form which can be used with a drive system in accordance with one embodiment of the invention;

FIGS. 3*a* and *b* illustrate cross sections of the connection between the propeller and the drive shaft in accordance with one embodiment of the invention; and FIGS. 4*a* and *b* illustrate the method steps which can be followed in one embodiment for forming the connection between the drive shaft and propeller in accordance with FIG. 3.

Referring firstly to FIGS. 1*a* and *b*, there is illustrated, schematically, one embodiment of a drive system for a craft, in this case a yacht 52. In this embodiment there is provided in the hull 54 an engine 56, connected by shaft 58 to gear box 60. This is in turn connected to shaft 62 which is connected to gear box 64 and, in turn, drive shaft 66. Connected to the free end 68 of the drive shaft 66 is a propeller 16 which has a body portion 70 with blades 72 depending outwardly from the body and which are driven by the rotation of the drive system.

Figure 2B:
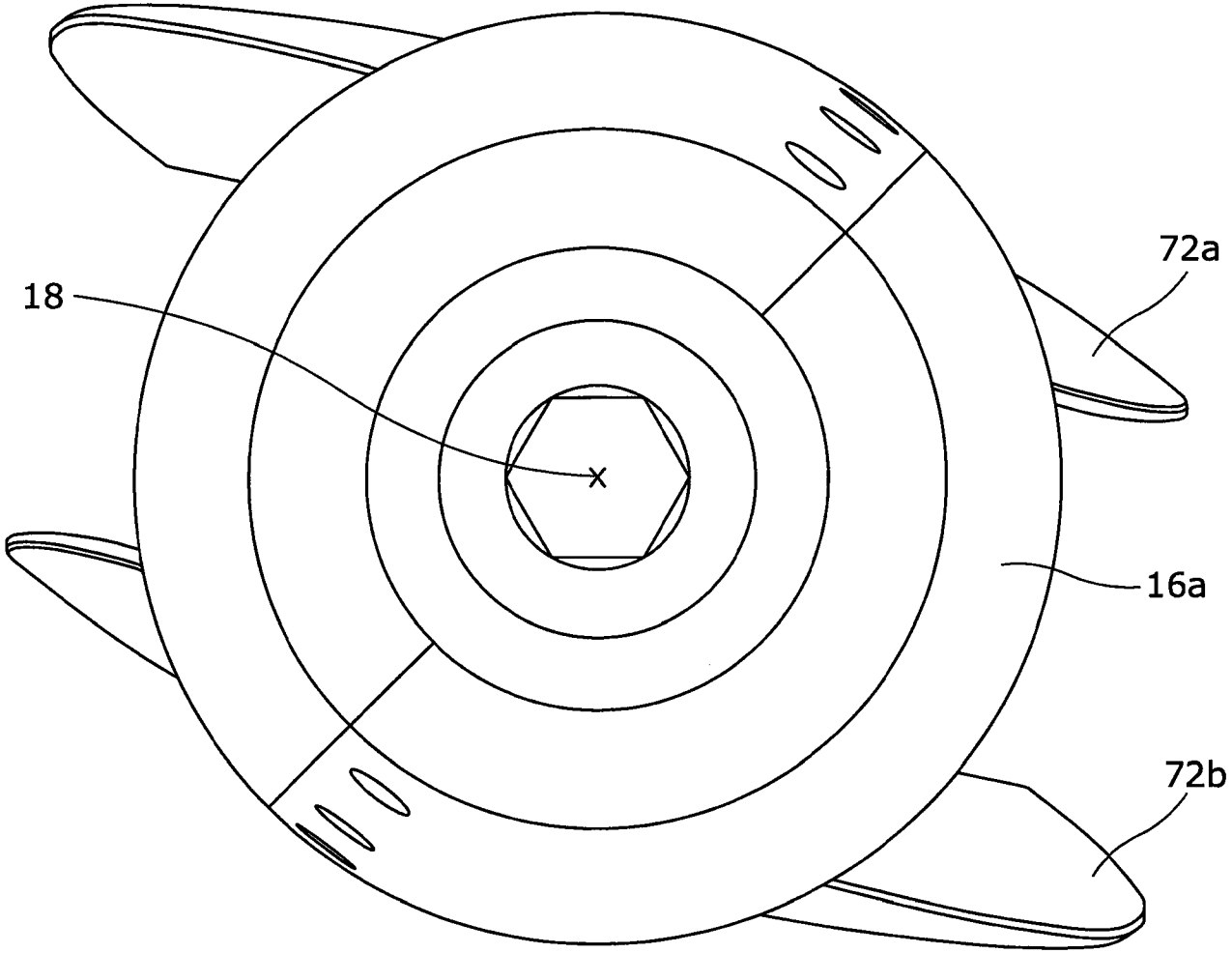

In FIGS. 2*a* and *b* there is illustrated a propeller 16 in accordance with one embodiment of the invention in which the blades 72*a* and 72*b* are movable between a storage position shown in bold lines in FIG. 2*a* and in FIG. 2*b*. The blades 72*a*, 72*b* move to an in use position about the pivot axis 24*a* and the in use position is shown in broken lines in FIG. 2*a*. The longitudinal axis 18 of the propeller is in line with the longitudinal axis 67 of the shaft 66.

FIGS. 3*a* and *b* illustrate elevation and plan cross sectional views of the connection between the drive shaft 66 via location means 68 and the propeller body portion 70 in accordance with one embodiment of the invention. Only the body 70 of the propeller 16 is shown with the port 28 therein which has an open end 29 and into which there is provided and located the location means 68 of the shaft 66. In this case the location means includes splines 30 which run along the same and which engage, in this embodiment with splines 30' of a casing 32 which is located around the location means 68. This means that the casing 32, which is mechanically engaged with the location means 68, is effectively integrated with the same and rotates along with the location means 68.

It should be noted that in alternative embodiment the casing 32 may not be provided. Furthermore, while the use of the spline drive connection formations as described in this embodiment of the invention is typical, it should be noted that this is not the only method of attaching the drive connection between the propeller to the drive shaft. Other engineering possibilities include options such as shrink fits, welding, tapered connections, with, or without, keyways and/or with nuts.

In this embodiment, between the external surface 34 of the casing 32 and the internal surface 36 of the port of the propeller body portion 70 there is defined a cavity 38 which receives therein, a deformable non-compressible material to form a sleeve 40. It is shown that the sleeve 40 is annular in cross section along line AA. In this embodiment the thickness of the annular wall 41 varies along the length thereof. In the embodiment shown, the thickness varies such that the intermediate portion 42 of the wall, is thicker than the portions 44, 46 at opposing ends.

While the material, which in one embodiment is polyurethane rubber, is deformable, the same is provided so as to be substantially not compressible at the pressures in which the drive system will be required to operate. This ensures that the movement of the propeller body portion 70 with respect to the drive shaft 66/casing 32 in the direction 48 is not possible and therefore the propeller is always maintained in the required location with respect to the drive shaft 66 so as to receive the rotating drive force therefrom as the shaft rotates and therefore allows the propeller to be driven to rotate in direction 50. In addition, the provision of the deformable material means that any relative movement which is caused by vibration, between the drive shaft 66 and the propeller body portion 70 is absorbed by a relative deformation of the material so that the deformation acts to dampen the effect of the vibration and hence allows the propeller blades to rotate in a more controlled and predictable path and therefore allows the propulsion which can be achieved by the drive system to be increased, be more efficient and be more reliable.

A further feature is that the material used for the sleeve 40 is non-conductive and therefore acts to electrically isolate the drive shaft 66 from the propeller body portion 70 and therefore reduces the occurrence and speed of corrosion of both the propeller and the drive shaft 66.

These advantages, alone and in combination, serve to extend the life of the propeller and the drive system as a whole.

FIGS. 4*a* and *b* illustrate a particular series of method steps which can be performed to achieve the join between the propeller and the drive shaft in accordance with one embodiment of the invention.

Figure 4B:
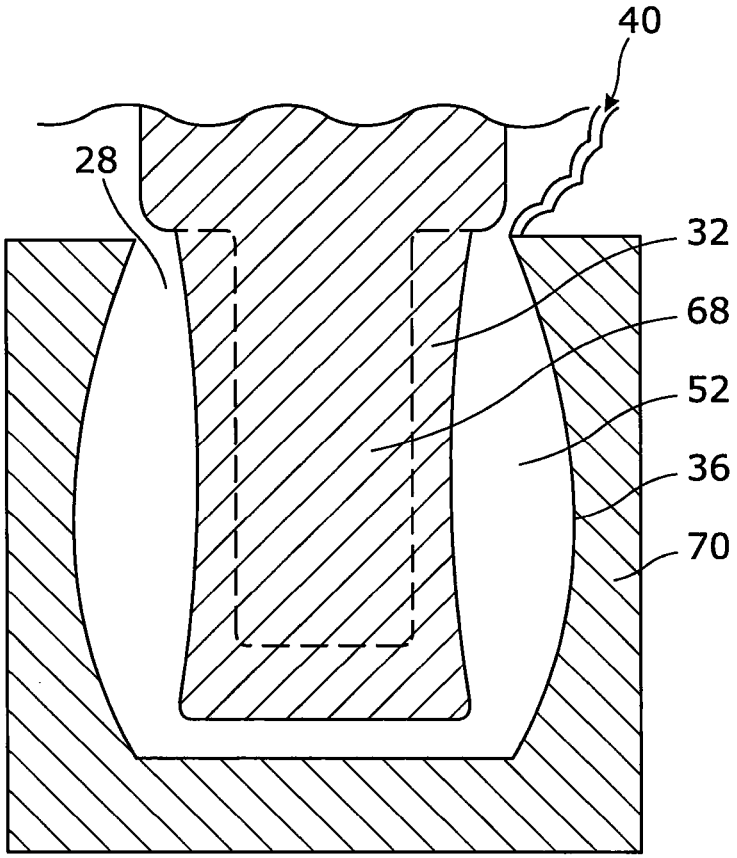

In FIG. 4*a* it is illustrated the manner in which the drive shaft 66 with the location means 68 at the free end, is located with the casing 32 thereon and the external face 34 of the casing is formed so as to provide the required shape of one side of the deformable material sleeve 40 which is to subsequently be engaged therewith. The location means 68 and casing 32 are then placed into the port 28 of the propeller body as shown in FIG. 4*b* and the internal face 36 of the propeller body port 28, is formed so as to form the opposing face of a mould 52 which has the varying wall thickness so as to provide the variation in the annular wall thickness of the sleeve 40 as defined previously.

A liquid polyurethane rubber material is then poured into the mould cavity 52 to fill the same such that the sleeve wall 41 has varying thickness as discussed. It will therefore be seen that the thickness of the sleeve 40 wall 41 can be adjusted along its length by the suitable shaping of one or both of the surfaces 34, 36. The decision as to the thickness of the sleeve wall is made with respect to selecting whatever thickness best absorbs the torsional oscillations of any particular drive configuration with which the sleeve is to be provided and this may be achieved after testing various drive assemblies and then defining predetermined sleeve formation for each.

In an alternative option to that shown in FIGS. 4*a* and *b* a solid preformed sleeve can be used and then the inner and outer components of the connection between the drive shaft location means 68 and the propeller body portion 70 are arranged to be placed around the same and in engagement therewith.

Furthermore, in whichever embodiment, drive formations are typically provided on the respective surfaces 34, 36 of the propeller port and the drive shaft casing so as to allow the required rotational drive to be imparted from the casing to the propeller body via the deformable material sleeve 40 as the extent of deformation is not sufficient to prevent this from occurring whilst the deformability is sufficient to allow any vibration or clatter between the propeller body portion 70 and the drive shaft location means 68 to be dampened.

The invention claimed is:

1. A drive apparatus for a craft in water, said drive apparatus comprising a drive means, one or more shafts which are provided in connection with the drive means via one or more gear assemblies and at least one of said shafts having a free end with location means to allow the same to be located with a propeller of the said craft to impart rotational drive to the propeller and wherein said location means are at least partially located within a port in the body of the propeller and intermediate said location means and the walls of the said port there is provided an at least partially deformable sleeve which separates the propeller body from the said shaft and retains the propeller body with the location means, the sleeve having a closed end.

2. Apparatus according to claim 1 wherein the sleeve in cross section is provided with annular walls.

3. Apparatus according to claim 1 wherein the sleeve is formed such that the thickness of an annular wall varies along the length of the sleeve.

4. Apparatus according to claim 1 wherein a first end of the sleeve which lies at, or adjacent to the opening into the port has a narrower annular wall thickness than a further portion of said annular wall.

5. Apparatus according to claim 1 wherein there is provided a casing which is in drive engagement with the location means and is located in the port of the propeller body to allow drive to be imparted from the shaft to the propeller.

6. Apparatus according to claim 5 wherein the shape of the sleeve located against the wall of the casing is such as to allow drive to be imparted to the sleeve and hence to the body of the propeller.

7. Apparatus according to claim 1 wherein the wall of the port and the location means or casing are provided so as to contact and define the shape of the opposing surfaces of the sleeve.

8. Apparatus according to claim 1 wherein a material used to form the sleeve is sufficiently deformable so as to take into account variance in the drive components.

9. Apparatus according to claim 1 wherein a material used to form the sleeve is substantially non-compressible so as to maintain the propeller and shaft in drive engagement.

10. Apparatus according to claim 1 wherein the sleeve is substantially non-conductive so as to electrically isolate the propeller from the said location means of the shaft.

11. Apparatus according to claim 1 wherein a deformable material is a polyurethane rubber.

12. A craft for water including a drive system as defined in claim 1.

13. Apparatus according to claim 1 wherein the said sleeve includes end portions and an intermediate portion located along the length of said sleeve.

14. Apparatus according to claim 13 wherein the thickness of walls of the said sleeve walls at said portions varies along the said length of the sleeve.

15. Apparatus according to claim 14 wherein the wall at the intermediate portion is thicker than the walls at said end portions.

16. Apparatus according to claim 1 wherein the sleeve is rotatable under the influence of the rotation of the said shaft located in said port.

17. A drive apparatus for a craft in water, said drive apparatus comprising a drive means, one or more shafts which are provided in connection with the drive means via one or more gear assemblies and at least one of said shafts having a free end with location means to allow the same to be located with a propeller of the said craft to impart rotational drive to the propeller and wherein said location means are at least partially located within a port in the body of the propeller and intermediate said location means and the walls of the said port there is provided an at least partially deformable sleeve which separates the propeller body from the said shaft and retains the propeller body with the location means, wherein a material is introduced in a liquid form into a cavity formed between the propeller body and the shaft location means, or casing when provided.

18. A method of forming a drive system for a craft in water, said method including the steps of providing a drive means, one or more shafts which are provided in connection with the drive means via one or more gear assemblies and at least one of said shafts having a free end, forming location means at said free end to allow the same to be located with a propeller of the said craft to impart rotational drive to the propeller when the shaft is driven to rotate by the drive means, positioning said location means at least partially within a port formed in the body of the propeller and, intermediate said location means and the walls of the said port there is provided a cavity and wherein a substantially non-conductive material is retained in said cavity so as to separate the propeller body from the said shaft whilst retaining the propeller body in contact with the location means, the said material being introduced into said cavity in a flowable form and then sets in position in said cavity.

19. A method according to claim 18 wherein when formed, a sleeve is substantially non-conductive and/or deformable and/or substantially non-compressible.

* * * * *